US006195823B1

(12) United States Patent
Enriquez

(10) Patent No.: US 6,195,823 B1
(45) Date of Patent: Mar. 6, 2001

(54) OPENER FOR QUICK LOCK COUPLINGS ON A FERN SCOOP® STRETCHER

(76) Inventor: Oscar Enriquez, 800 Whitehall Dr., Pflugerville, TX (US) 78660

( * ) Notice: Subject to any disclaimer, the term of this patent is extended or adjusted under 35 U.S.C. 154(b) by 0 days.

(21) Appl. No.: 09/275,128

(22) Filed: Mar. 24, 1999

(51) Int. Cl.[7] ..... B25B 13/00
(52) U.S. Cl. ..... 7/138; 7/169
(58) Field of Search ..... 7/138, 169, 170; 81/3.55, 119, 488; 254/131

(56) References Cited

U.S. PATENT DOCUMENTS

| | | | | |
|---|---|---|---|---|
| D. 278,023 | * | 3/1985 | Junes | 81/3.55 |
| 1,609,732 | | 1/1926 | McLaughlin et al. . | |
| 2,640,382 | | 6/1953 | Grossman . | |
| 2,736,088 | * | 2/1956 | Thygeson | 254/131 |
| 2,920,517 | * | 1/1960 | Willey, Jr. | 81/119 |
| 4,089,077 | | 5/1978 | Morton . | |
| 4,210,035 | | 7/1980 | White . | |
| 4,236,427 | * | 12/1980 | Becnel | 254/131 |
| 4,463,631 | | 8/1984 | Barnes et al. . | |
| 4,474,087 | | 10/1984 | Widman . | |
| 4,617,842 | * | 10/1986 | Yang | 81/3.55 |
| 4,788,893 | * | 12/1988 | Sutton | 7/170 |
| 5,457,834 | | 10/1995 | Allen, Sr. . | |
| 5,806,380 | | 9/1998 | Wilsey . | |
| 5,934,159 | * | 8/1999 | Robichaud | 81/3.55 |

* cited by examiner

*Primary Examiner*—David A. Scherbel
*Assistant Examiner*—Joni B. Danganan
(74) *Attorney, Agent, or Firm*—Jospeh F. Long

(57) ABSTRACT

A keychain sized opener with an approximately one half inch cubical shaped head on a semirigid handle and positioning projection allows finger pressure on the head to facilitate opening of the industry standard Scoop type ® stretcher quick lock couplings even when the stretcher with a patient thereon is placed on a hospital bed is disclosed.

3 Claims, 6 Drawing Sheets

OPENER FOR QUICK LOCK COUPLINGS ON A FERN SCOOP® STRETCHER

BACKGROUND OF THE INVENTION

An industry standard, the FERNO SCOOP® Stretcher allows medical personnel to place a stretcher beneath a patient without lifting or logrolling. The scoop is a two piece unit with a head panel, a torso panel and a leg panel mounted on each of two adjustable length rails. The curved ends of the rails may be snapped together to form a rigid coupling that leaves a space between the panels but comfortably supports the patient.

When the stretcher with a patient thereon is placed on a bed the rigid coupling is difficult to unlock but if the patient should not be rolled unlocking is a necessity. The opener of this invention is preferably formed from a semi rigid plastic, has a projection narrow enough to slide behind an internal lock lever of the rail coupling, and a front projection that may be pushed downward with finger pressure to rotate the internal lock lever to easily open the quick lock coupling. This opener is small enough to be carried on a key chain and solves the opener problem. Since in emergency vehicles opening the valve on a small oxygen bottle is sometimes necessary the opener has a rectangular opening to allow a dual use of the opener for opening oxygen bottles.

SUMMARY OF THE INVENTION

The industry standard Scoop® stretcher has dual rails with curved ends and with head, torso, and leg panels to support a person with some space between the panels when the rails are locked together with quick lock couplings. The couplings must be designed to prevent accidental openings and with the present design are difficult to open. The invention comprises an approximately one half inch essentially cubical shaped head with a semirigid handle and a positioning projection on the head to position the head so that downward finger pressure on the head will partially rotate an internal locking lever in the quick lock coupling to disconnect the quick lock couplings. With couplings on each end of the stretcher rails disconnected, each half of the stretcher may slipped out from under the patient to cause minimal patient movement.

DETAILED DESCRIPTION OF THE DRAWINGS

Figure 1:
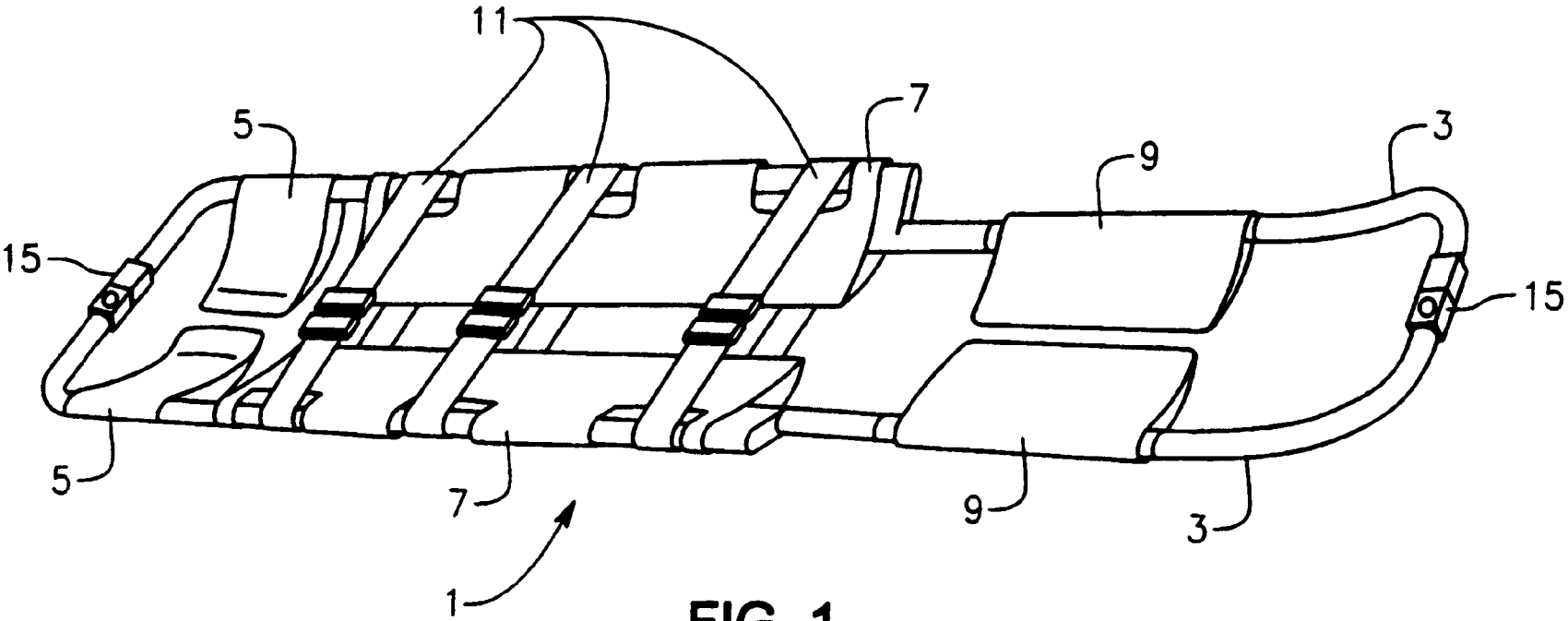
FIG. 1 Prior Art
FIG. 1 shows the scoop type stretcher.

The invention may best be understood from a detailed description of the drawings. FIG. 1 shows the Ferno Scoop® stretcher 1 which is an industry standard. Each rail 3 is adjustable in length and a head panel 5, a torso panel 7 and a leg panel 9 are rigidly attached thereto. There is a quick lock coupling 15 on the head end and similar quick lock coupling 15 on the foot end. Belt type restraints 11 are used to hold a patient firmly on the stretcher.

Figure 3:
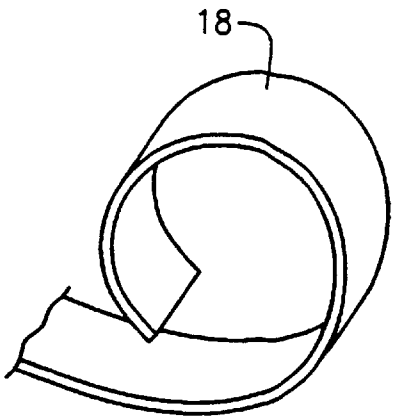
FIG. 3 Prior Art
FIG. 3 shows a spring for loading an internal lock lever in the quick lock coupling.

A three dimensional view of the quick lock couplings 15 on each end of rails 3 is shown in FIG. 3. Lockpin 19 is in one side of the coupling and when rails are pushed together the spring loaded internal lock lever 23 mounted on pivot pin 21 snaps over lock pin 19 to lock the rails rigidly in place. Operation of the quick lock couplings is also shown in FIG. 5.

Figure 2:
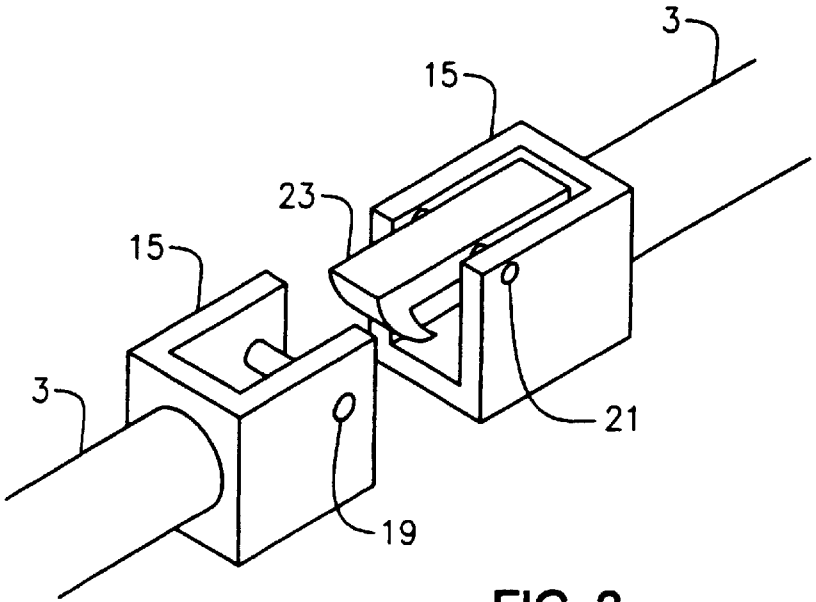
FIG. 2 Prior Art
FIG. 2 shows the quick lock coupling.
Figure 4:
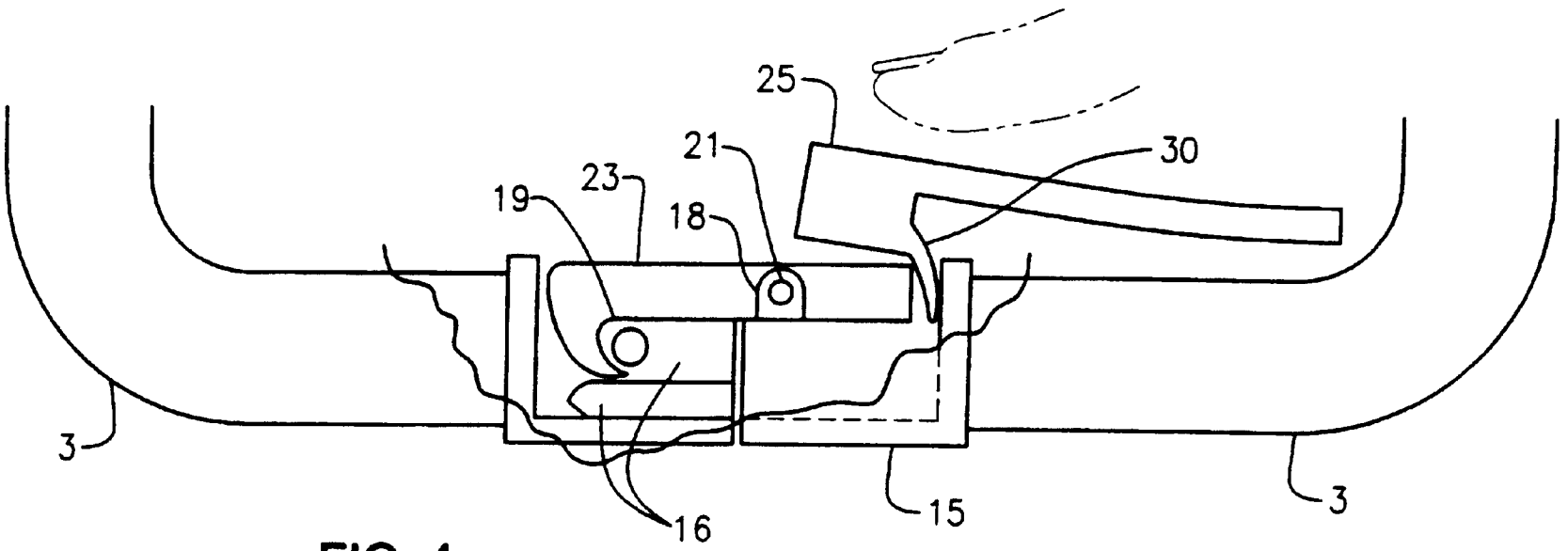
FIG. 4 shows an internal view of the quick lock coupling with the opener anchored in the starting position.

FIG. 3 shows a coil type spring 18 shown in the in use position in FIG. 4 to spring load internal lock lever 23 to snap to engage pin 19, FIG. 2; other types of springs to provide the same function would be equally useable.

FIG. 4*a* shows a cut-a-way view of quick coupling 15 in the locked position with pin 19 locked against projections 16 by internal lock lever 23; the internal lock lever which is rotatable on pin 21 is spring loaded with spring 18 to cause lever 23 to snap downward; opener 25 is shown in place with projection 30 preventing opener 25 from sliding forward as pressure is applied to rotate lever 23 downward.

Figure 5:
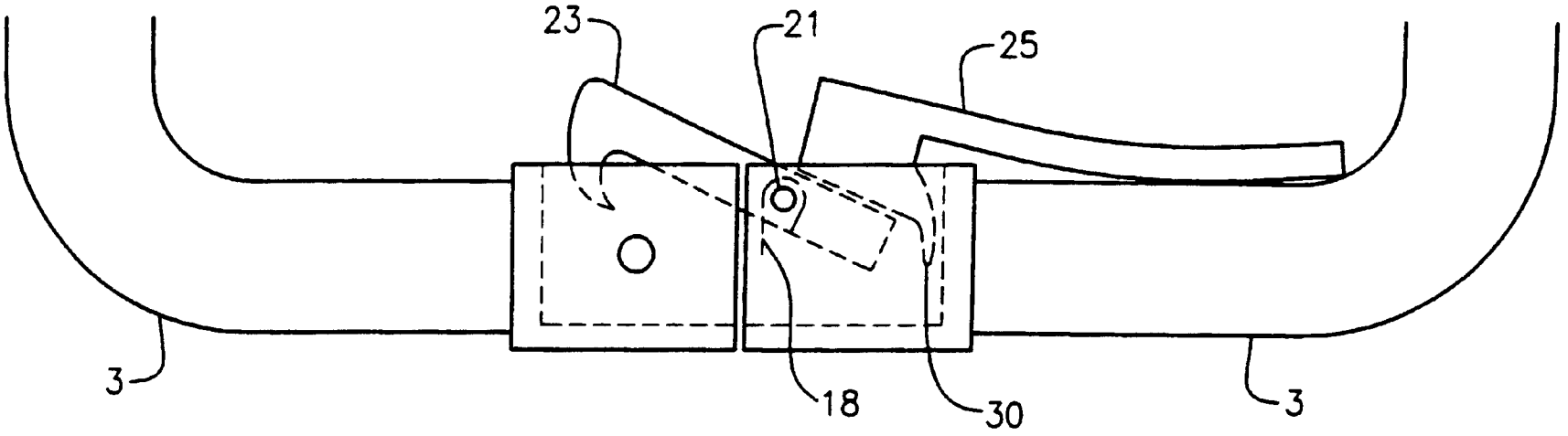
FIG. 5 shows the opener in the pushed down position to open the coupling.

FIG. 5 shows opener 25 pushed downward to rotate lever 23 upward to disengage pin 19 to open the quick opening coupling; the head of opener 25 must be shaped to allow partial entry into the quick opening coupling with downward finger pressure.

Figure 6:
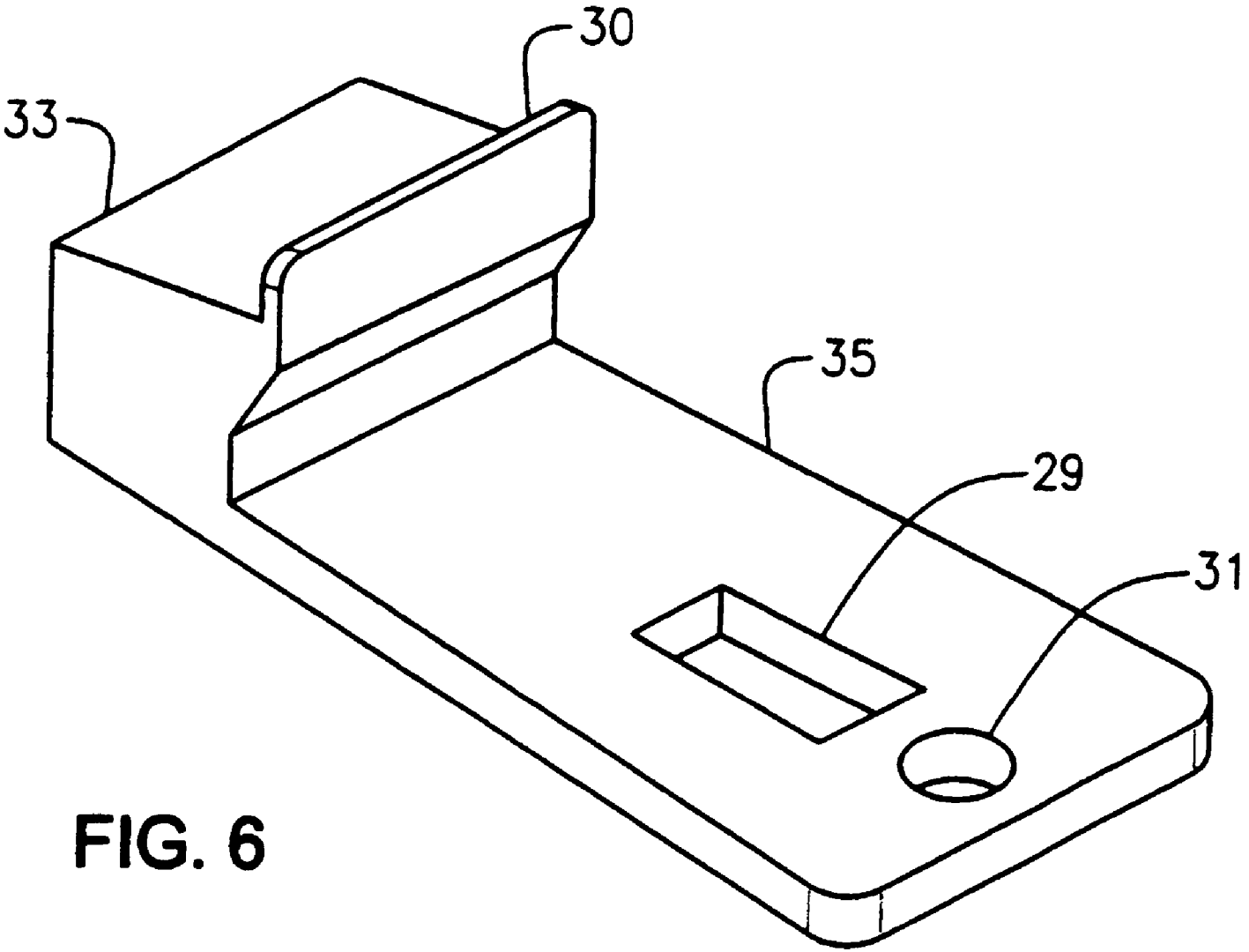
FIG. 6 shows a three dimensional view of a preferred embodiment of the opener.

FIG. 6 shows a three dimensional of the opener 25 with the head 33 integrally formed with the handle 35; hole 31 in the opener handle may be used to attach the opener to a key chain; rectangular opening 29 is sized to fit over and operate the outlet valve on the normal sized oxygen bottles found in emergency vehicles.

Figure 7:
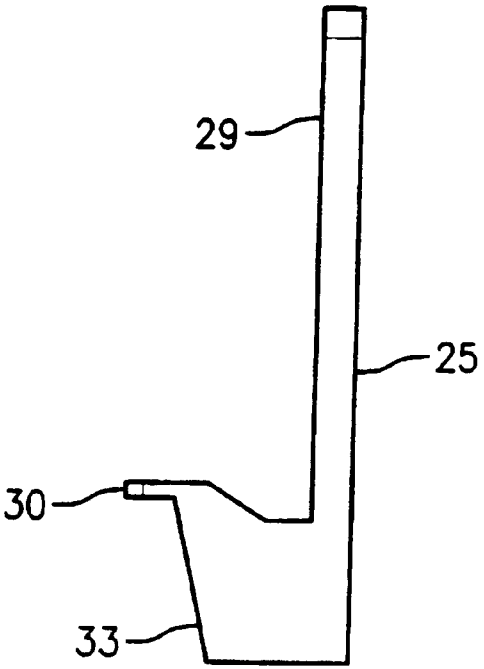
FIG. 7 shows a side view of the opener indicating relative size of the component parts.

FIG. 7 shows a side view of opener 25. The head 33 is approximately a one half inch cube with one sloping side and a projection 30. Projection 30 is about one sixteenth of an inch thick, about one eighth inch tall and about one half inch wide.

Figure 8:
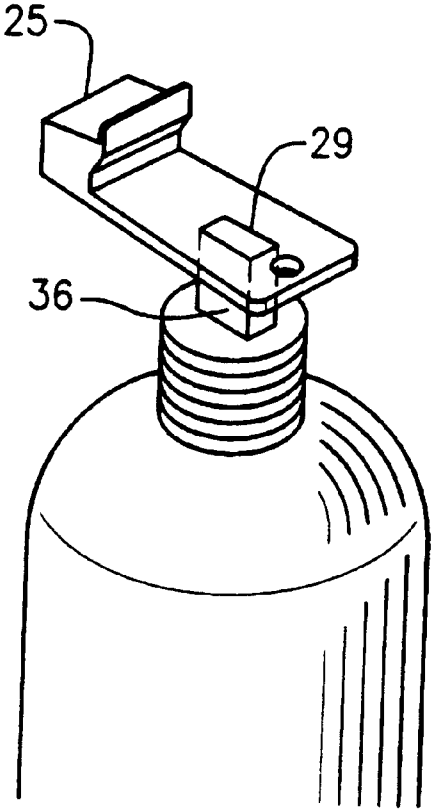
FIG. 8 shows a three dimensional view of the opener using the rectangular opening to open a rectangular valve.

FIG. 8 shows opener 25 as the rectangular opening 29 would be used to open a rectangular valve 36 on an oxygen bottle.

What is claimed is:

1. A manual opener in combination with quick lock couplings on a FERNO SCOOP® stretcher, the manual opener comprising a) a semirigid flat handle, b) a head means approximately one half inch wide integrally attached to a first end of said handle, c) a projection means approximately one sixteenth inch thick, one eighth inch high and one half inch wide attached to a rearward lower face of said head means and acting to prevent said head means from slipping forward when engaged in said quick lock coupling;

d) said head means and said projection means being so shaped as to allow said head means to partially enter said quick lock coupling to rotate a pivotal internal lever in said coupling upward to disengage said coupling when pressure is applied to a top portion of said head means.

2. The manual opener as claimed in claim 1 wherein said handle has a rectangular opening therein to render said handle useful for opening a valve on an oxygen bottle.

3. A manual opener in combination with a quick lock coupling for FERNO SCOOP® stretcher, the manual opener comprising a) an essentially cubic shaped head means with a semi-rigid handle;

b) a projection means on a lower side of said head means, said projection means sized to slide into said quick lock coupling and acting to position said head means to allow downward pressure on said head means to cause an internal spring loaded lock lever to disengage from a lock pin in said quick lock coupling thereby disconnecting one end of said FERNO SCOOP® stretcher.

* * * * *